US006769592B2

(12) United States Patent
Strååt

(10) Patent No.: US 6,769,592 B2
(45) Date of Patent: Aug. 3, 2004

(54) STAPLER

(75) Inventor: Olle Strååt, Hestra (SE)

(73) Assignee: Isaberg Rapid AB, Hestra (SE)

( * ) Notice: Subject to any disclaimer, the term of this patent is extended or adjusted under 35 U.S.C. 154(b) by 0 days.

(21) Appl. No.: 10/248,901

(22) Filed: Feb. 28, 2003

(65) Prior Publication Data

US 2003/0168492 A1 Sep. 11, 2003

(30) Foreign Application Priority Data

Mar. 5, 2002 (SE) ..... 0200674-0

(51) Int. Cl.[7] ..... B27F 7/19; B25C 5/16
(52) U.S. Cl. ..... 227/131; 270/37; 227/155
(58) Field of Search ..... 227/131, 155, 227/156, 134; 270/37, 53, 58

(56) References Cited

U.S. PATENT DOCUMENTS 5,279,494 A * 1/1994 Kitajima et al. ..... 270/58.14
5,427,296 A * 6/1995 Chen ..... 227/7
5,772,197 A * 6/1998 Aoki et al. ..... 270/58.08
5,806,750 A * 9/1998 Yamanushi et al. ..... 227/155
6,223,965 B1 * 5/2001 Nakatsuka ..... 227/111
6,543,667 B2 * 4/2003 Yoshie et al. ..... 227/120
6,616,029 B1 * 9/2003 Andersson ..... 227/155

FOREIGN PATENT DOCUMENTS

| | | |
|---|---|---|
| CA | 2306362 A1 | 10/2001 |
| GB | 2318080 A | 4/1998 |
| JP | 9109062 A | 4/1997 |

* cited by examiner

*Primary Examiner*—Scott A. Smith
(74) *Attorney, Agent, or Firm*—Howrey Simon Arnold & White LLP

(57) ABSTRACT

Stapling device (1) for stapling a workpiece (23), typically in the form of a sheaf of paper. The stapler (1) includes a support base (3) and a stapling unit (2) connected by a connecting piece (4) in a moveable manner. The stapling unit has a stapling magazine (6) in which staple blanks (24) are stored. A driver (7) is provided that drives the stapler so as to perform a stapling operation, and during which operation the workpiece is stapled. The support base is provided with an anvil (10) on which the workpiece is placed and against which stapling is carried out; the staple being secured in the workpiece with an orientation such that its longitudinal direction (T) is perpendicular to the longitudinal direction (L) of the stapler, whereby the connecting piece (4) extends along only one long side (21) of the stapler.

6 Claims, 10 Drawing Sheets

STAPLER

CROSS REFERENCE TO RELATED APPLICATIONS

The present application claims priority to Swedish Patent Application No. 0200674-0 filed Mar. 5, 2002. Said application is expressly incorporated herein by reference in its entirety.

BACKGROUND OF INVENTION

1. Technical Field

The present invention relates to a stapler designed for stapling together a workpiece, primarily a sheaf of papers. The stapler comprises or includes a base part and a stapling unit connected by a connecting device enabling the base part and stapling unit to move relative to each other. The stapling unit has a staple magazine in which staple blanks are stored and a drive unit that operates the stapler so as to perform a stapling operation whereby the workpiece is stapled. The base part is provided with an anvil surface on which the workpiece is placed and against which stapling is carried out, the staple being applied to the workpiece in an orientation such that its longitudinal direction is transverse to the longitudinal direction of the stapler.

2. Background Information

Staplers of the type described above are generally known. These types of staplers typically feature a connecting device with a part on each side of the longitudinal direction of the stapler. The disadvantage of these types of connecting devices is that they make it impossible for the workpiece (papers) that is to be stapled to be subsequently passed through the stapler after being stapled together.

The capability for the workpiece to pass through the stapler upon completion of stapling is one which has become highly demanded in instances particularly where staplers are located in copying machine and the machine's layout requires that the workpiece be carried on a continuous conveyor, and is ultimately stapled prior to discharge into a collection tray. To achieve this feature, staplers have previously been made with separate stapling units and base parts that were mounted individually in the copying machine layout. These machines, however, suffer from the disadvantages of being complicated, since they consist of a large number of components and are, therefore, are also expensive to manufacture. Still further, these configurations are difficult to install since the stapling unit and base part may easily become displaced relative to one another and thereby preventing stapling from being carried out correctly, and possibly even entirely prevented. Furthermore, the stapling unit and base part may become displaced relative to each other following a short or long period of service, requiring costly service to be carried out at frequent intervals.

SUMMARY OF INVENTION

As explained in the background above, there exists a need for staplers that permit a workpiece to pass therethrough, and that are of simple in design, easy to install, and in which the risk of relative displacement between the stapling unit and base part during use is reduced, if not eliminated. The present invention overcomes these disadvantages by means of a stapler of the type previously described, but which is characterized by its inclusion of a connecting device which extends on only one of the long sides of the stapler.

The present invention is further characterized in that the connecting device comprises or includes a first guide arrangement located in the front area of the stapler and a second guide arrangement located in the rear area of the stapler.

Alternatively, the present invention is characterized in that the connecting device is provided with a spindle coupling located in the rear area of the stapler, which coupling connects the stapling unit and base part in a pivoting manner, and enables the base part and stapling unit to be pivoted relative to each other in a direction towards and away from each other, and with a guide arrangement located in the front area of the stapler.

BRIEF DESCRIPTION OF DRAWINGS

The invention shall hereinafter be described with reference to the included Figures, of which.

DETAILED DESCRIPTION

Figure 1:
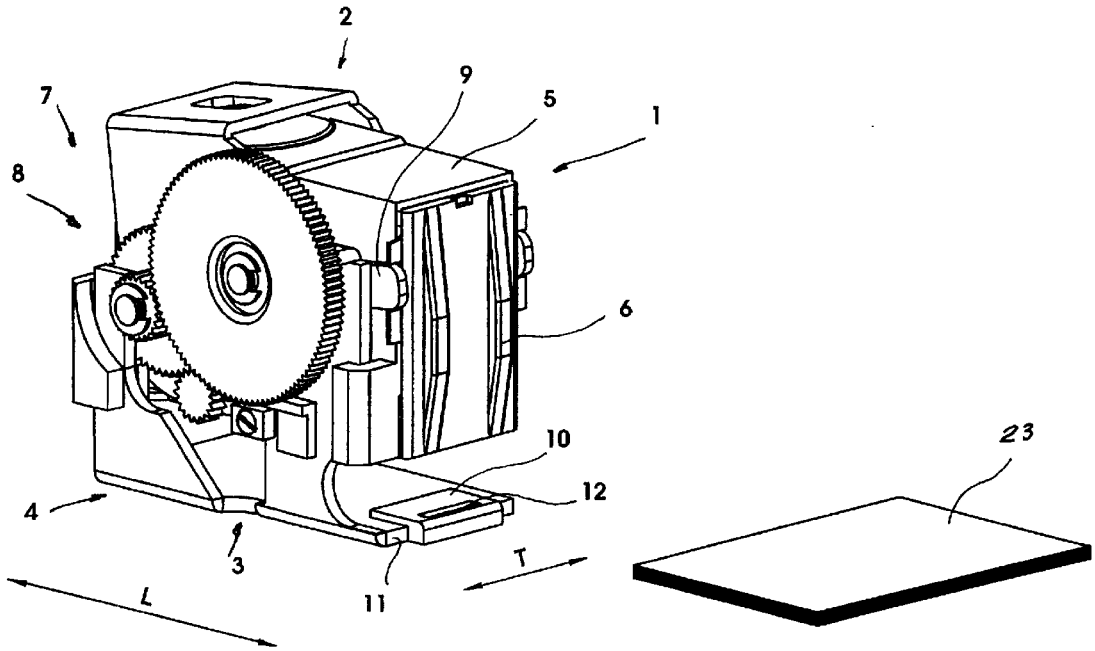
FIG. 1 is a perspective view of a stapler configured according to the present invention, and in an initial, pre-stapling position.

FIG. 1 shows a stapler 1 or stapling device comprising (including) a stapling unit 2 and a base part 3, which are moveable relative to each other and are connected by a connecting device 4. The stapling unit has a housing 5 and a staple magazine 6 in which staple blanks (not visible in the figure) are loaded. The housing 5 is further provided with a drive unit 7 that includes a drive motor (not shown) that drives a gear train 8 which, in known manner, is connected to drive arms 9. The function of the drive unit will be clear from the remainder of the description below, but will be described only in schematic form since it is not of significance to the working of the invention. FIG. 1 also shows an anvil surface 10 located on the base part 3, at a front edge 11 of the stapler, and which is provided with a slot 12 extending in the direction of the arrow T, which is transverse to the longitudinal direction of the stapler 1 which is indicated by the arrow L. As will be clear from the further description below, stapling takes place against the anvil surface 10 and the formed staple is aligned in the direction indicated by the arrow T which, therefore, also makes the formed staple transverse in orientation to the longitudinal direction L of the stapler.

Figure 5:
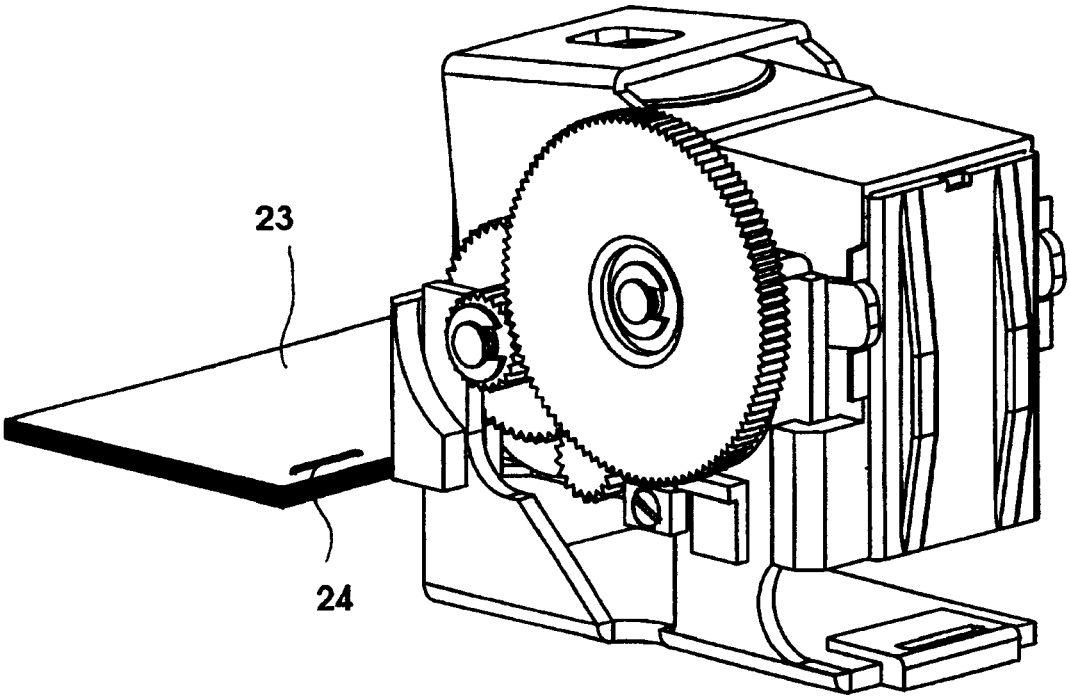
FIG. 5 is a view similar to FIG. 4, but showing the stapled workpiece removed from the stapler.
Figure 6:
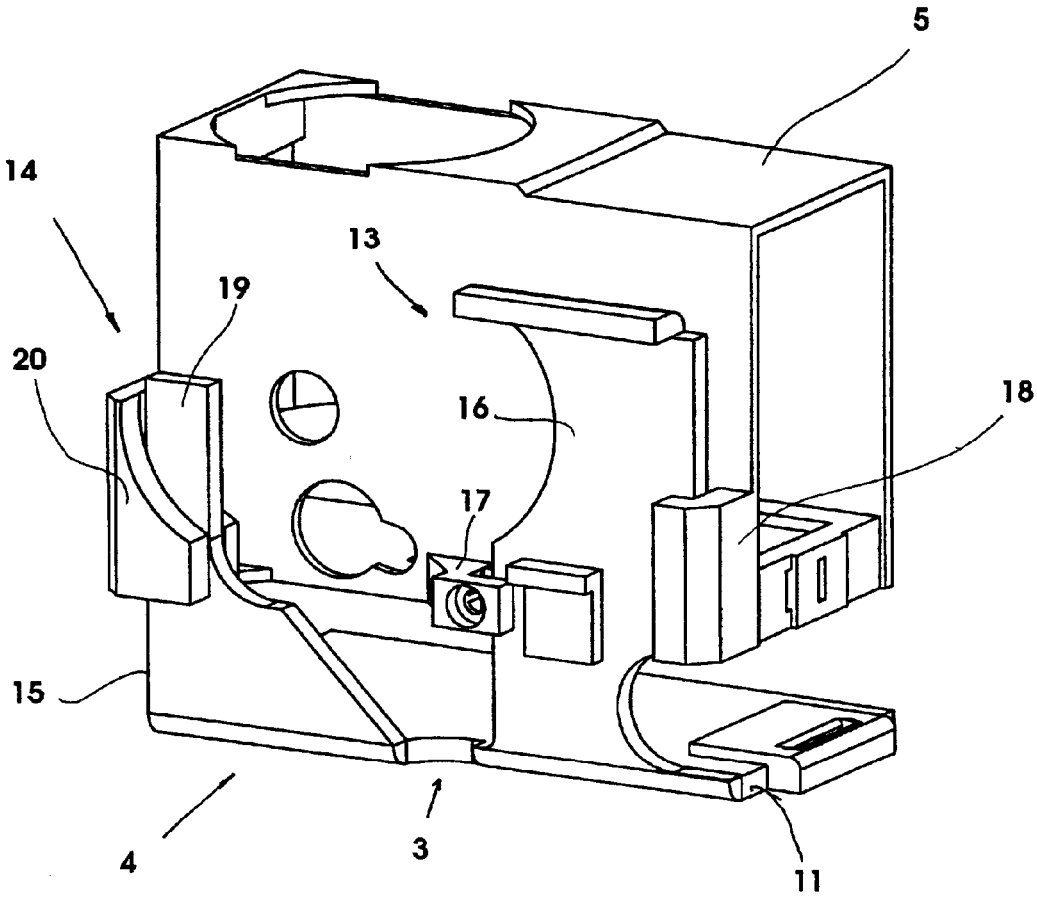
FIG. 6 is a perspective view showing in greater detail a connecting device configured in accordance with the teachings of the present invention, in an expanded, non-stapling configuration.
Figure 7:
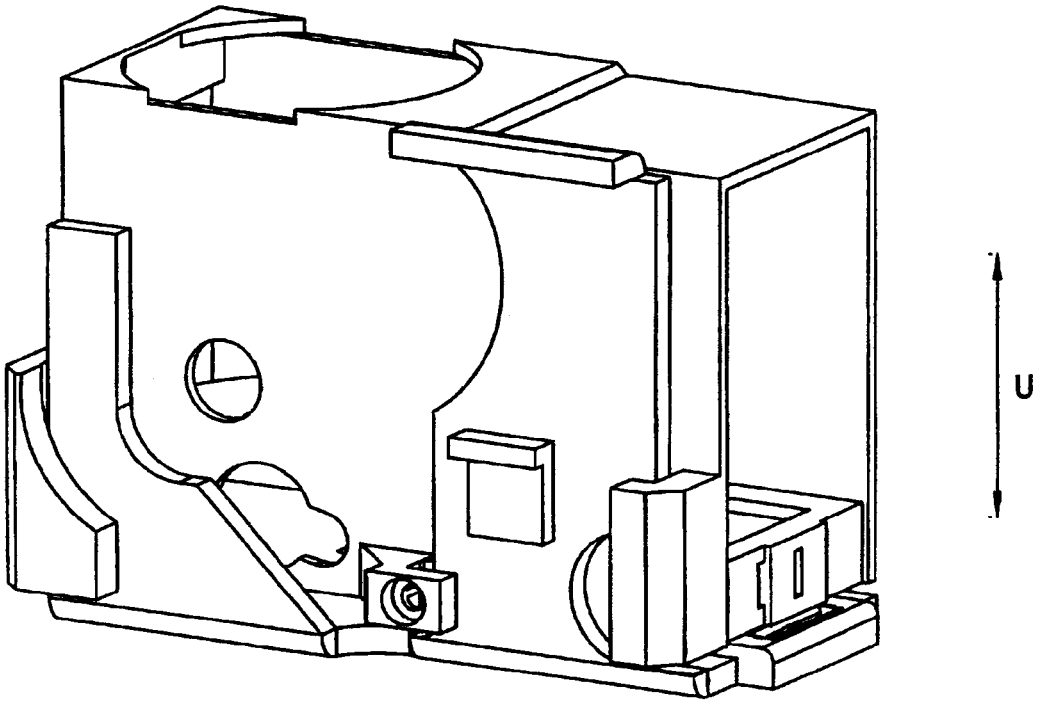
FIG. 7 is a perspective view corresponding to FIG. 6, but with the connecting device in a contracted, stapling configuration.

FIGS. 6 and 7 show the housing 5, the base part 3 and the connecting device 4. In FIG. 6, the housing and base part are shown a distance away from each other; a position which the stapler assumes as an initial position corresponding to that shown in FIG. 1 and FIG. 5. In FIG. 7, the housing 5 and base part 3 are shown in a broad-together configuration corresponding to that shown in FIG. 3. The figures show that the connecting device 4 comprises a front guide arrangement 13 located at the front edge 11 of the stapler and a rear guide arrangement 14 located at the rear edge 15 of the stapler. The guide arrangement 13 comprises a slide 16, a first slide guide 17 and a second slide guide 18. Guide arrangement 14 comprises a slide 19 and a slide guide 20. The slides 16 and 19 are guided by the guides 17 and 18, and 20 respectively, in a manner familiar to those skilled in this art. In this way, the slides 16 and 19 are movable upward and downward in the direction of the double-arrow U. Those persons skilled in this art will readily understand how the connection is established between the base part and stapling unit such that the base part and stapling unit are moveable relative to each other and, therefore, can be moved between the positions shown in FIGS. 6 and 7.

Figure 10:
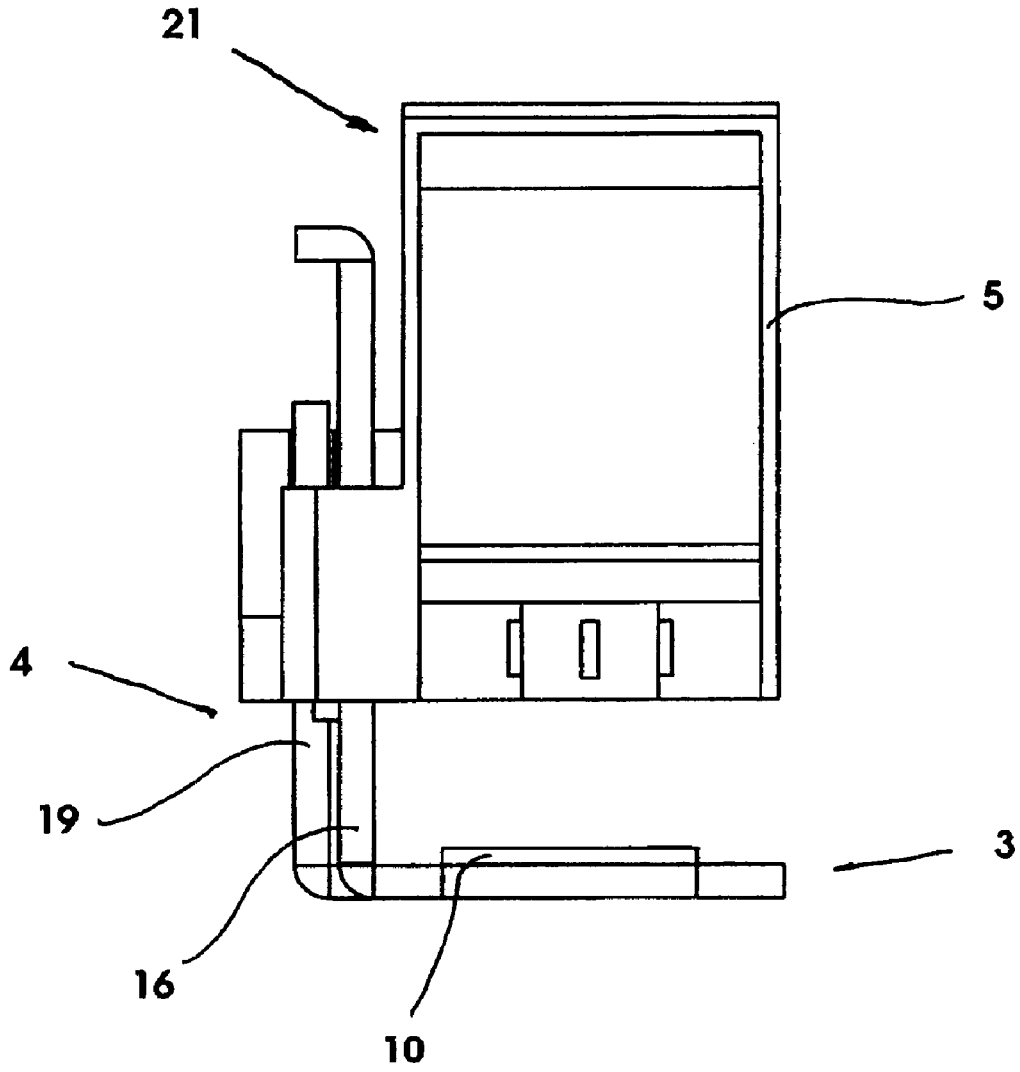
FIG. 10 is a detail view showing the environmental location of the connecting device in accordance with the present invention.

FIG. 10 shows the base part 3 and housing S as viewed from a front side. The figure shows that the connecting device 4 is attached to only one long side 21 of the apparatus 1.

Figure 8:
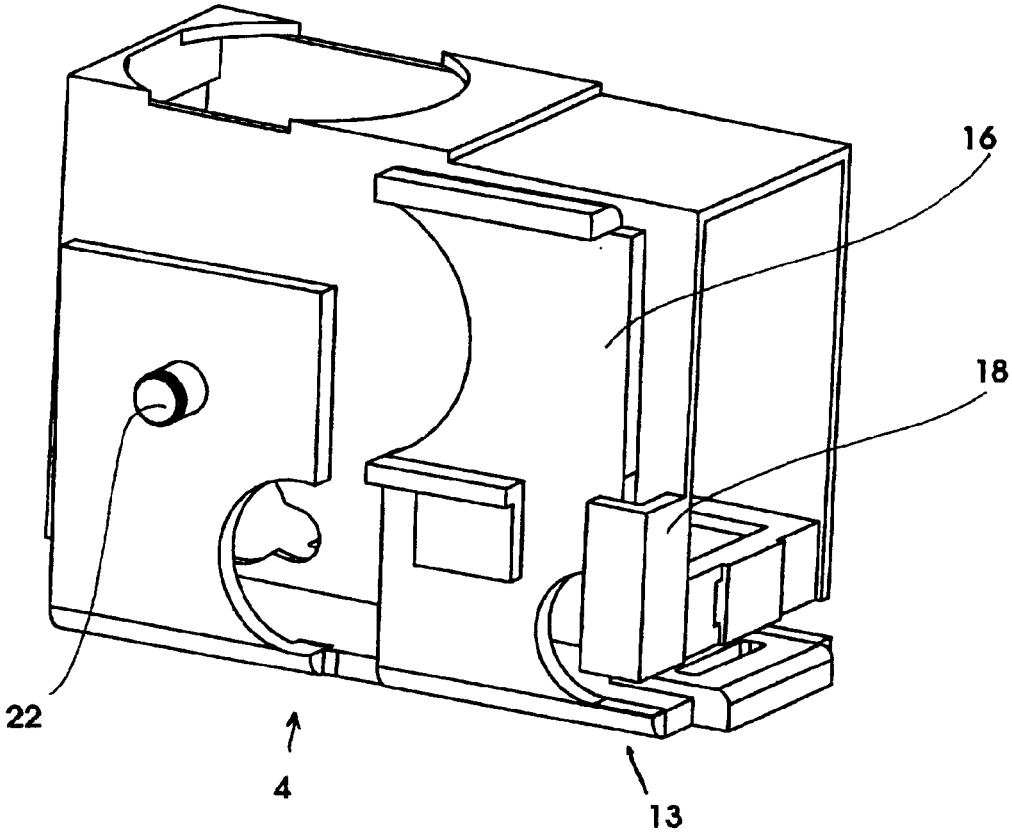
FIGS. 8 and 9 are perspective views showing details of an alternative connecting device configured in accordance with the present invention.
Figure 9:
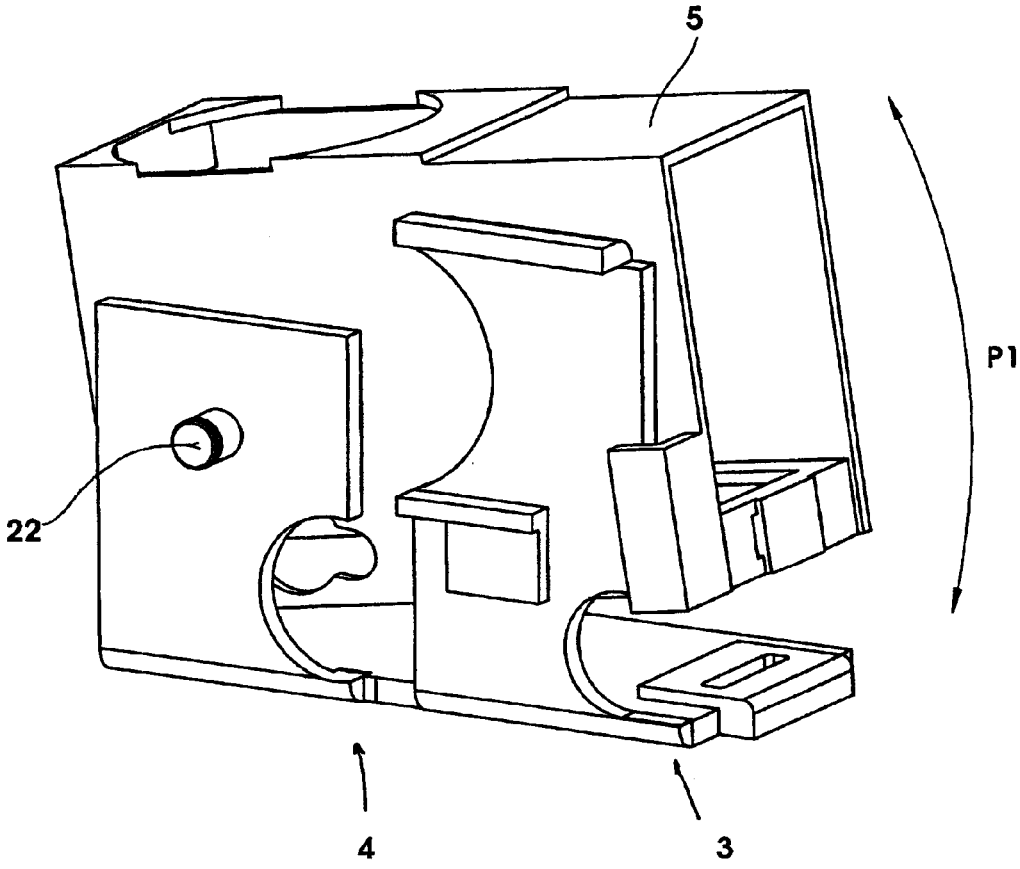

FIGS. 8 and 9 show an alternative of the connecting device 4. In this version, the rear guide arrangement is replaced by a spindle coupling 22, which connects the base part 3 and the housing 5 in a pivoted manner, and about which the base part 3 and housing 5 can be pivoted towards and away from each other in the direction of the double arrow P1 between the positions shown in FIG. 8 and FIG. 9, respectively. In the front guide arrangement 13, the guide 17 has been omitted, while the slide 16 and guide 18 have been modified in a manner familiar to those persons skilled in the art and such that the slide 16 is guided by the guide 18 during the movements. Though this modification is not shown in the figure, it will be readily understood by the skilled person.

Figure 2:
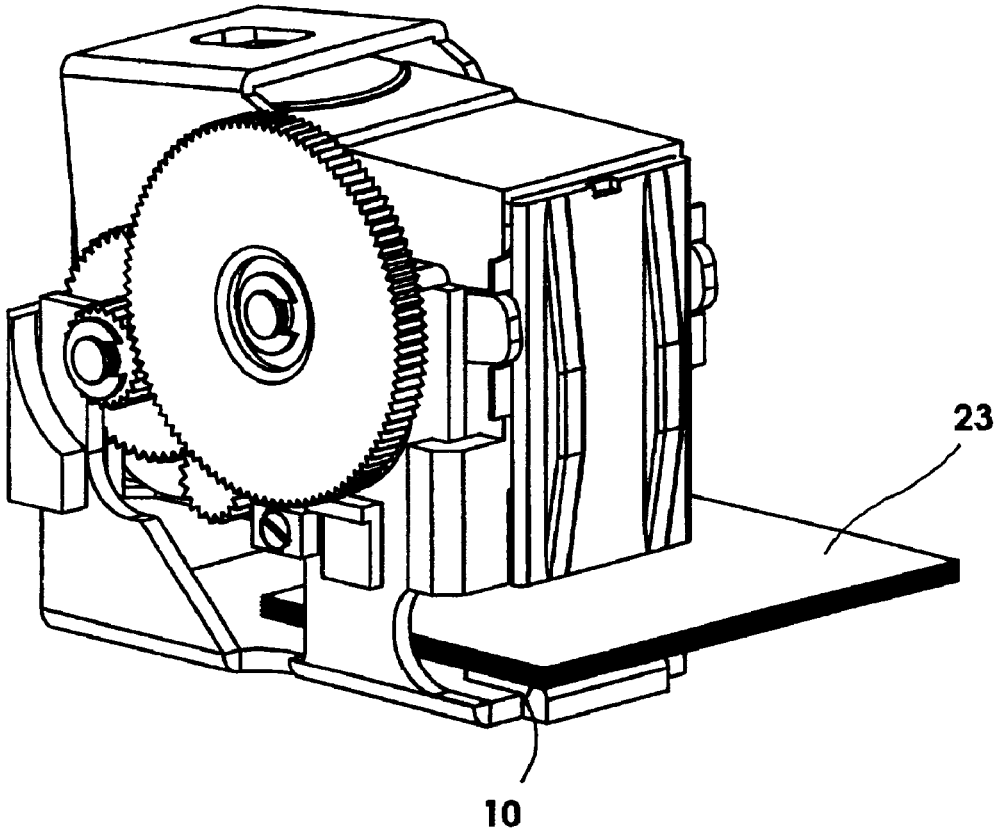
FIG. 2 is a corresponding perspective view of the device shown in FIG. 1, but with a workpiece (sheaf of papers) placed in position for effecting stapling together of the workpiece.
Figure 3:
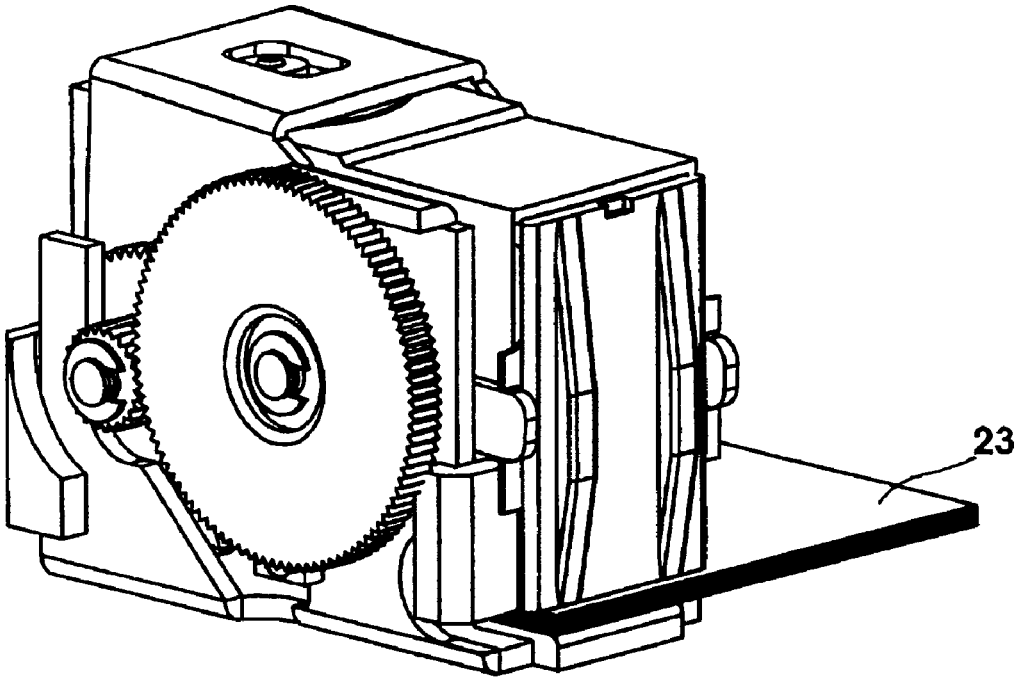
FIG. 3 is a similarly corresponding perspective view of the device shown in FIG. 1, but a stapling action is being executed.
Figure 4:
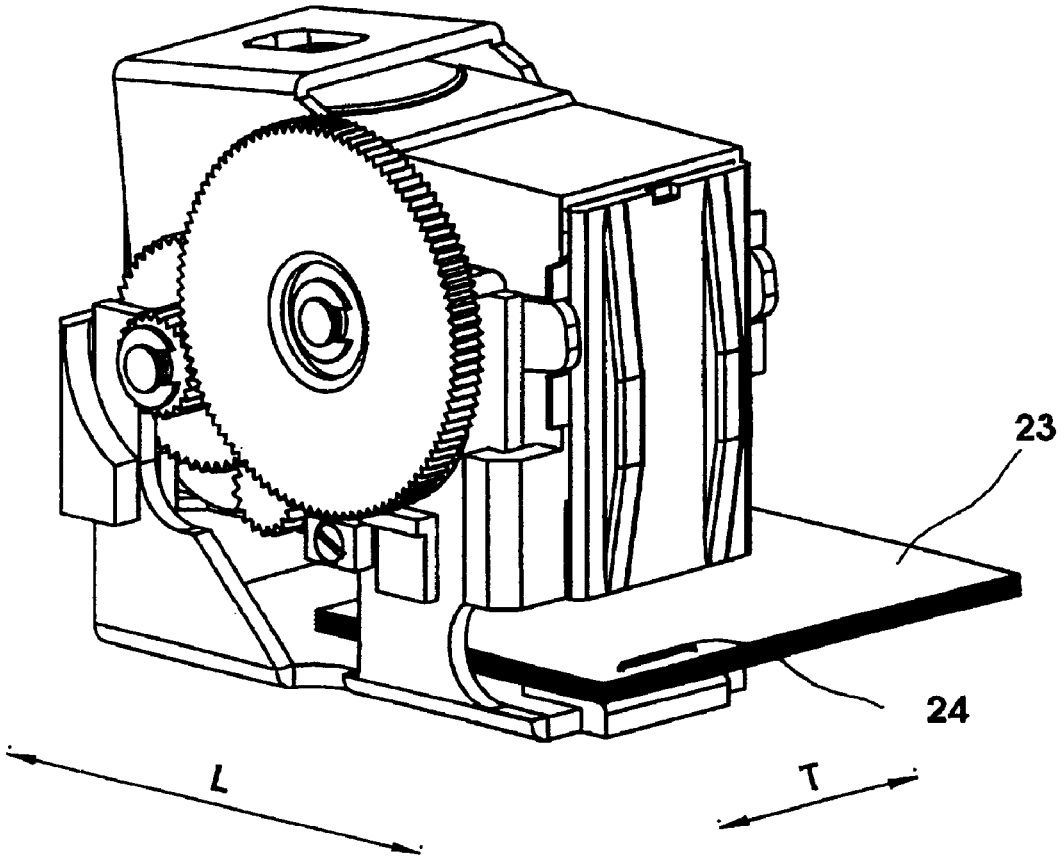
FIG. 4 is a view similar to FIG. 1 showing the stapler returned to the initial position and the workpiece stapled.

The stapler 1 will hereinafter be described with reference to FIGS. 1–5, in which a stapling operation is depicted. In FIG. 1, the stapler 1 is shown in an initial position, with the workpiece (a sheaf of paper) to be stapled placed in position at the front of the apparatus. In FIG. 2, the workpiece 23 is placed on the anvil 10. In FIG. 3, the drive unit 7 has driven the stapling unit and base part together, in which position a staple is also driven into the workpiece (not visible on the figure). In FIG. 4, the drive unit has driven apart from the base part and stapling unit. This figure further shows that a staple 24 has been secured to the workpiece 23 and that the longitudinal direction of the staple, as indicated by the double arrow T, is transverse to the longitudinal direction L of the stapler. In FIG. 5, the workpiece has been passed through the stapler and the stapler is in the initial position shown in FIG. 1. FIGS. 1–5 further show that the workpiece 23 passes through the stapler during the stapling operation, which is made possible by the fact that the connecting device is located on only one long side of the stapler.

The invention is not limited by the above description, but only by the accompanying patent claims.

What is claimed is:

1. A stapling device for stapling a workpiece such as a sheaf of papers, said stapling device comprising:

a base part and a stapling unit interconnected by a connecting device in a manner that permits relative movement between the stapling unit and base part;

a stapling magazine in which staple blanks are storable and a drive unit for driving the stapling device to perform a stapling operation in which a workpiece is stapled;

said base part being provided with an anvil surface configured to receive a workpiece positioned thereupon, and against which a stapling action is performed and in which a staple is stapled into a workpiece with an orientation such a longitudinal direction (T) of the staple is transverse to a longitudinal direction (L) of the stapling device; and said connecting device extends along a single long side of the stapling device thereby permitting a workpiece to be passed through the stapling device.

2. The stapling device as recited in claim 1, wherein the connecting device further comprises a first guide arrangement located in a front area of the stapling device and a second guide arrangement located in a rear area of the stapling device.

3. The stapling device as recited in claim 1, further comprising:

the connecting device having a spindle coupling located in a rear area of the stapling device and which connects the stapling unit and base part together in a pivotable manner; and a guide arrangement located in a front area of the stapling device.

4. A stapling arrangement configured to permit a stapled workpiece to pass directly therethrough, without interruption, along a longitudinal axis thereof, the stapling device comprising:

a stapling unit (2) coupled to a base unit (3) by a connecting device (4) and thereby establishing a stapling device (1), the connecting device (4) configured to facilitate relative stapling motion between the stapling unit (2) coupled to the base unit (3);

the stapling device (1) having a lengthwise dimension greater than a perpendicularly oriented widthwise dimension thereby establishing two long sides of the stapling device (1); and the coupling device (4) extending between the stapling unit (2) and the base unit (3) exclusively on one of the two long sides of the stapling device (1) thereby establishing an impedance-free, open gap space between the stapling unit (2) and the base unit (3) along the other of the two long sides of the stapling device (1).

5. The stapling arrangement as recited in claim 4, further comprising:

the impedance-free, open gap space extending continuously between front and rear access locations to the open gap space thereby permitting workpieces to pass through the stapling device during a stapling process on a deviation-free path between the front and rear access locations.

6. The stapling arrangement as recited in claim 5, further comprising:

a staple magazine associated with the stapling unit, the staple magazine oriented to position staples, during the stapling process, substantially perpendicular to a longitudinal axis of the stapling device.

* * * * *